United States Patent [19]

Ogawa et al.

[11] 4,055,426

[45] Oct. 25, 1977

[54] PROCESS FOR STABILIZING A COLOR DEVELOPING SOLUTION

[75] Inventors: Junkichi Ogawa; Tsumoru Ishii; Isao Shimamura, all of Minami-ashigara, Japan

[73] Assignee: Fuji Photo Film Co., Ltd., Minami-ashigara, Japan

[21] Appl. No.: 718,274

[22] Filed: Aug. 27, 1976

[30] Foreign Application Priority Data

Aug. 27, 1975 Japan ..... 50-103730

[51] Int. Cl.[2] ..... G03C 7/00; G03C 5/30

[52] U.S. Cl. ..... 96/66.4; 96/56

[58] Field of Search ..... 96/66 R, 50, 66.4, 66.5, 96/56

[56] References Cited

U.S. PATENT DOCUMENTS

| | | | |
|---|---|---|---|
| 1,663,959 | 3/1928 | Schestakoff | 96/66.5 |
| 3,751,252 | 8/1973 | Smith et al. | 96/50 |
| 3,751,255 | 8/1973 | Wilson et al. | 96/60 R |
| 3,794,488 | 2/1974 | Henn et al. | 96/66 R |

OTHER PUBLICATIONS

Mason, Photographic Processing Chemistry, pp. 14–45, 1966.

*Primary Examiner*—Mary F. Kelley

[57] ABSTRACT

A process for stabilizing a color developing solution which comprises adding one or more hydroxamic acid compounds represented by the following formula to the color developing solution:

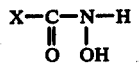

wherein X represents a hydrogen atom, an alkyl group having 1 to 4 carbon atoms, an unsubstituted or substituted aryl group having 6 to 10 carbon atoms, an amino group, an alkylamino group having 1 to 4 carbon atoms or an arylamino group.

18 Claims, No Drawings

PROCESS FOR STABILIZING A COLOR DEVELOPING SOLUTION

BACKGROUND OF THE INVENTION

1. Field of the Invention

The present invention relates to a color photographic process, particularly, to a process for stabilizing a color developing solution to improve preservability (storage capability) thereof and reduce the occurrence of fog or stain caused by long-term processing using a developing solution which has been permitted to stand in contact with air for a period of time, i.e., developing agent is oxidized by contact with the oxygen in the air, whereupon developing capability is lowered and color fog results.

2. Description of the Prior Art

In color photographic processes, a color photographic material produced by applying silver halide emulsions (containing or not containing couplers such as a cyan, yellow or magenta coupler) to a support is image-wise exposed to light and then subjected to a series of processings to reproduce a color image on the photographic material.

Fundamental steps in such processings comprise a color development and a desilvering. Namely, in the color development of the exposed silver halide color photographic material, exposed silver halide oxidizes a color developing agent while it is reduced to silver at the same time, and the oxidized color developing agent reacts with couplers to form a dye image. In the thus processed color photographic material, developed silver formed by the prior step is oxidized by the function of an oxidizing agent (called a bleaching agent) at desilvering and is removed from the photographic material by dissolving by means of a silver ion chelating agent (called a fixing agent). Consequently, only a dye image is left in the photographic material. An actual development processing usually comprises auxiliary steps for preserving the photographic and physical qualities of the image or for improving the preservability of the image in addition to the above described two fundamental steps, that is, the color development and the desilvering. There are, for example, steps such as hardening for preventing excess softening of sensitive layers during processing, stopping for effectively stopping the development reaction, image stabilization for stabilizing the image and defilming for removing a backing layer on the support. Such color photographic processing has been commonly used since 1940.

In addition to the above described processings, there are color intensifying processings as have been described in detail in, for example, *The Theory of the Photographic Process* written by C. E. K. Mees, 2nd Edition, Chapter 25, U.S. Pat. No. 3,674,490 and Japanese Patent Application Nos. 9728/73 and 9729/73.

Fog generally occurs in color photographic sensitive materials when they are subjected to color development. Such fog is called "development fog"; the occurrence of such fog can be prevented by adding halides such as potassium bromide or potassium iodide or organic anti-fogging agents such as 1-phenyl-5-mercaptotetrazole, benzotriazole or 5-nitrobenzimidazole, etc., to a developing solution. However, apart from development fog, fog also occurs due to the use of color developing solutions which has been permitted to stand in contact with the air for extended periods of time, as earlier described. Such fog is called "color fog" or "stain", and the occurrence of such fog cannot be prevented by adding the above described halides or organic anti-fogging agents (hereinafter, "fog" in this specification means color fog or stain, unless otherwise indicated).

The occurrence of fog increases with elevated development temperatures and it becomes particularly remarkable when processing at a high temperature of above 30° C. It is believed that one cause of fogging is a deterioration of the color developing solution which is accelerated by elevated development temperatures. Accordingly, the occurrence of fog is closely related to the preservability of the color developing solution, and it is believed that a main cause of fogging is due to oxidation products formed by a partial oxidation of the color developing agent included in the color developing solution with the passage of time. As such oxidation products of the color developing agents, there are oxidants (semiquinone or quinonediimine) of the color developing agents, quinonemonoimines formed by a deamination reaction, oxidants thereof, and quinonemonoimine-sulfuric acid addition products, etc. On the other hand, hydrogen peroxide is a by-produced peroxide. Among these oxidation products, some of them react with couplers in the sensitive material to form dyes, whereby fog is caused. Further, it is believed that fog is also caused by the hydrogen peroxide. In any case, these compounds bring about fog in unexposed areas of the color photographic material. On the other hand, such fog appears not only in unexposed white areas where dyes should not be formed, but also the occurrence of fog in unexposed layers brings about stain when, for example, only one or two layers among the photographic emulsion layers in the sensitive material are exposed to light. For example, in the case that only a red-sensitive layer is exposed to light, fog occurs in a green-sensitive layer and a blue-sensitive layer to cause some degree of magenta and yellow coloring, whereby a cyan color image having low purity is formed.

This color fog in the white areas and stain in the color image areas brings about a remarkable deterioration in the quality of the photographic image.

Usually, a sulfite or a water soluble salt of a sulfite and hydroxylamine is added to a color developing solution in order to improve preservability. In the case of using sulfite only, though preservability is somewhat improved, fog remarkably occurs. On the other hand, in the case of using the water soluble salt of a sulfite and hydroxylamine, the preservability of the developing solution is remarkably improved and it is possible to reduce the occurrence of fog caused by the elapsed developing solution.

It has been reported, however, that hydroxylamines are injurious to humans (*The Merck Index—An Encyclopedia of Chemical and Drugs* by P. G. Stecher, 8th Ed. (1953)). In the Pharmacopoeia of Japan, hydroxylamine and water soluble salts thereof are designated as poisonous substances. They are difficult to handle because of the danger when they are handled by amateurs.

Recently, many preservatives have been suggested other than hydroxylamines. For example, 2-anilinoethanol (U.S. Pat. No. 3,823,017) and dihydroxyalkenes (U.S. Pat. No. 3,615,503) have been suggested. However, both 2-anilinoethanol and dihydroxyalkenes have insufficient stability and do not show an anti-fogging effect.

SUMMARY OF THE INVENTION

A first object of the present invention is to provide a process for stabilizing color developing solutions.

A second object of this invention is to provide a color developing solution having lower toxicity by which the occurrence of fog caused by use of the fatigued developing solution is prevented, and a method of processing using such a color developing solution.

As the result of many studies, the present inventors found that all objects of the present invention can be attained by processing using a color developing solution containing a hydroxamic acid compound represented by formula (I):

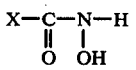

(I)

wherein X represents a hydrogen atom, an alkyl group having 1 to 4 carbon atoms, a substituted or unsubstituted aryl group having 6 to 10 carbon atoms, which carbon atom range includes the carbon atoms present in substituents (for example, a phenyl, alkylphenyl, alkoxyphenyl or hydroxyphenyl group, etc.), an amino group, an alkylamino group having 1 to 4 carbon atoms, or an arylamino group (for example, an anilino, toluidino, anisidino or xylydino group, etc.).

DETAILED DESCRIPTION OF THE INVENTION

Preferred substituted aryl groups include a phenyl group having at least one alkyl group, alkoxy group, acyl group, carboxyl group, sulfo group, halogen atom, hydroxyl group, amino group or nitro group; more preferred substituted aryl groups include a phenyl group having at least one cyano group, formyl group, hydroxyalkyl group, aminoalkyl group, carboxyalkyl group, sulfoalkyl group, halogenated alkyl group or nitroalkyl group; and most preferred substituted aryl groups include a phenyl group having at least one cyanoalkyl group or formylalkyl group.

Preferred examples of the hydroxamic acids include the compounds described in the following table.

| No. of Compound | Substituent X in Formula (I) | Melting Point (° C) | Reference |
|---|---|---|---|
| 1 | —H | 82 | Beilstein Organische Chemie (4th Ed.) Vol. 2, page 90 |
| 2 | —$CH_3$ | 87 - 88 | " Vol. 2, page 187 |
| 3 | —$C_6H_5$ | 126 - 130 | " Vol. 9, page 301 |
| 4 | —$C_6H_4OH$ (ortho) | 177 (decomposition) | " Vol. 10, page 98 |
| 5 | —$NH_2$ | 137 - 141 | " Vol. 3, page 95 |
| 6 | —$NHCH_3$ | 53 (decomposition) | " Vol. 4, page 70 |
| 7 | —$NHC_6H_5$ | 140 (decomposition) | " Vol. 12, page 376 |

The hydroxamic acids represented by the above described compounds are used in an amount of from about 0.001 to about 20 g per liter of the developing solution, preferably an amount of from 0.01 to 10 g per liter of the developing solution.

Since the stabilizing agents of the present invention are added to a color developing solution, preferred stabilizing agents are water soluble; accordingly, preferred substituents on the stabilizing agents are polar groups.

The color developing solution of the present invention is generally used for color development at about 20° to about 60° C, preferably at 30° to 45° C.

The pH of the color developing solution used in the present invention is in the range of about 7 to 14, preferably about 8 to 13.

The developing solution may contain various compounds known as components of developing solutions. For example, sodium hydroxide, potassium hydroxide, sodium carbonate, potassium carbonate, sodium tertiary phosphate, potassium tertiary phosphate, potassium metaborate, borax, etc., as alkali agents or buffering agents, which can be used alone or as a mixture of two or more thereof.

For the purpose of imparting a buffering function, for convenience in preparation or to increase ionic concentration, various salts may be used, examples of which include disodium hydrogen phosphate, dipotassium hydrogen phosphate, sodium dihydrogen phosphate, potassium dihydrogen phosphate, sodium bicarbonate, potassium bicarbonate, alkali borates, alkali nitrates and alkali sulfates.

Further, a suitable amount of an anti-fogging agent(s) may also be added. As such anti-fogging agents, inorganic halides or known organic anti-fogging agents can be used. Typical examples of inorganic halides include bromides such as sodium bromide, potassium bromide or ammonium bromide and iodides such as potassium iodide or sodium iodide. Examples of organic anti-fogging agents include 6-nitrobenzimidazole as described in U.S. Pat. No. 2,496,940, 5-nitrobenzimidazole as described in U.S. Pat. Nos. 2,497,917 and 2,656,271, diaminophenazine as described in Nihon Shashin Gakkaishi, 11, 48 (1948), o-phenylenediamine and heterocyclic compounds such as mercaptobenzimidazole, methylbenzothiazole, mercaptobenzoxazole, thiouracil, 5-methylbenzotriazole and compounds as described in Japanese patent publication No. 41675/71. Moreover, compounds as described in *Kagakushashin Binran,* Vol. 2, page 119 (issued by Maruzen Co., 1959), can be used as the anti-fogging agents.

Development inhibitors as described in Japanese patent publications Nos. 19039/71 and 6149/70 and U.S. Pat. No. 3,295,976 can be used to control surface layer development, if desired.

In addition, ammonium chloride, potassium chloride or sodium chloride may be added, if desired or necessary.

Further, suitable development accelerating agents may be added, if desired or necessary, examples of which include pyridinium compounds and other cationic compounds as described in U.S. Pat. No. 2,648,604, Japanese patent publication No. 9503/69 and U.S. Pat. No. 3,671,247, cationic dyes such as phenosafranine, neutral salts such as thallium nitrate or potassium nitrate, nonionic compounds such as polyethylene glycol or derivatives thereof or polythioethers, etc., as described in Japanese patent publication No. 9504/69 and U.S. Pat. Nos. 2,533,990, 2,531,832, 2,950,970 and 2,577,127, organic solvents as described in Japanese patent publication No. 9509/69 and Belgian Pat. No. 682,862 and organic amines such as ethanolamine, ethylenediamine or diethanolamine, etc. In addition, accelerating agents as described in *Photographic Processing Chemistry* written by L. F. A. Mason, pages 40 - 43 (Focal Press, London (1966)) may be used.

Furthermore, benzyl alcohol or phenethyl alcohol as described in U.S. Pat. No. 2,304,925 and pyridine, ammonia, hydrazine and amines as described in Nihon Shashin Gakkaishi, 14, 74 (1952) are also effective developing accelerating agents.

Moreover, sodium sulfite, potassium sulfite, potassium bisulfite and sodium bisulfite may be added.

Further, polyphosphoric acid compounds such as sodium hexametaphosphate, sodium tetrapolyphosphate, sodium tripolyphosphate, potassium hexametaphosphate, potassium tetrapolyphosphate or potassium tripolyphosphate, etc., and aminopolycarboxylic acids such as ethylenediaminetetraacetic acid, nitrilotriacetic acid, cyclohexanediamine tetraacetic acid, iminodiacetic acid, N-(hydroxymethyl)ethylenediaminetriacetic acid or diethylenetriaminepentaacetic acid, etc., may be used as water softeners. Though the amount of water softener depends upon the hardness of the water used, it is generally in the range of from 0.5 to 10 g/l. In addition to these materials, calcium or magnesium masking agents may be used. These are described in detail in *Belgisches Chemiches Industry* written by J. Willems, 21, page 325 (1956) and 23, page 1105 (1958).

If desired, organic solvents may be added in order to increase the solubility of components of the developing solution, particularly the solubility of a developing agent.

Examples of such organic solvents include ethylene glycol, hexylene glycol, diethylene glycol, methyl cellosolve, methanol, ethanol, acetone, triethylene glycol, dimethylformamide, dimethylsulfoxide and compounds as described in Japanese patent publications Nos. 33378/72 and 9509/69.

Though the amount of the organic solvent(s) can be widely changed according to the composition of the developing solution, it is generally below 50 volume % of the developing solution, preferably below 10 volume %. Conventional developing solutions are substantially aqueous solutions; however, in certain cases developing solutions can be utilized wherein only organic solvents are used and water is not present. The present invention is also applicable to such developing solutions which are substantially anhydrous.

p-Phenylenediamine derivatives are the most commonly used developing agents in this invention. Examples of the p-phenylenediamine derivatives include N,N-diethyl-p-phenylenediamine hydrochloride, 2-amino-5-diethylaminotoluene hydrochloride, 2-amino-5-(N-ethyl-N-lauryl)aminotoluene, 4-[N-ethyl-N-(β-hydroxyethyl)amino]aniline sulfate, 2-methyl-4-[N-ethyl-N-(β-hydroxyethyl)amino]aniline sulfate, N-ethyl-N-(β-methanesulfonamidoethyl)-3-methyl-4-aminoaniline sesquisulfate monohydrate as described in U.S. Pat. No. 2,193,015, N-(2-amino-5-diethylaminophenylethyl)methanesulfonamide sulfate as described in U.S. Pat. No. 2,592,364, N,N-dimethyl-p-phenylenediamine hydrochloride, 4-amino-3-methyl-N-ethyl-N-methoxyethylaniline, 4-amino-3-methyl-N-ethyl-N-β-ethoxyethylaniline, 4-amino-3-methoxy-N-ethyl-N-β-butoxyethylaniline and salts thereof (for example, sulfates, hydrochlorides, sulfites or p-toluenesulfonates, etc.) as described in U.S. Pat. Nos. 3,656,950 and 3,698,525, and the like. In addition to these compounds, the compounds described in *Kagakushashin Binran*, Vol. 2, page 72 (published by Maruzen Co. 1959), and *Photographic Processing Chemistry* written by L. F. A. Mason, pages 226–229 (Focal Press, London, 1966) can be used.

N-methyl-p-aminophenol hemisulfate (Metol), benzyl-p-aminophenol hydrochloride, N,N-diethyl-p-aminophenol hydrochloride, p-aminophenol sulfate, Phenidone and N,N,N′,N′-tetramethyl-p-phenylenediamine hydrochloride may be used as auxiliary developing agents together with the developing agent. They are usually used in an amount of about 0.01 to about 1.0 g/l.

Moreover, the following materials can be added, if desired or necessary, to the color developing solution.

For example, competitive couplers (non-colored couplers) such as citrazinic acid, J-acid, or H-acid, etc., as described in Japanese patent publications Nos. 9505/69, 9506/69, 9507/69, 14036/70 and 9508/69 and U.S. Pat. Nos. 2,742,832, 3,520,690, 3,560,212 and 3,645,737.

As fogging agents, alkali metal borohydrides, aminoborane or ethylenediamine, etc., as described in Japanese patent publication No. 38816/72.

Typical examples of color developing solutions comprising the above described various components are described in *Kagakushashin Binran* (Maruzen, 1959), page 72.

When the developing solution of the present invention is utilized on a commercial scale, a developing agent, stabilizing agent, water and alkali will be present in the developing solution. Typically, the developing agent will be dissolved in water and then the solution activated by the addition of an alkali (activated for purposes of oxidation); in this case, an antioxidation agent (i.e., a stabilizing agent) is required.

The amount of stabilizing agent depends on the amount of oxygen absorbed in the developing solution, and, it is thus difficult to unequivocally state the amount of stabilizing agent required in any particular case. However, generally speaking, the greater the amount of oxygen absorbed in the developing solution, the greater the amount of stabilizing agent required, with a converse affect being noted with lesser amounts of oxygen being absorbed.

The photosensitive emulsion layers of the color photographic sensitive material may contain compounds which form a dye by reacting with an oxidized developing agent, i.e., a coupler. Such couplers have a structure such that they do not diffuse into another layer during production or processing of the photographic sensitive material.

As yellow couplers, open-chain-diketomethylene compounds are generally used. Examples of such couplers include those described in U.S. Pat. Nos. 3,341,331, 2,875,057 and 3,551,155, German patent application (OLS) No. 1,547,868, U.S. Pat. Nos. 3,265,506, 3,582,322 and 3,725,072, German patent application (OLS) No. 2,162,899, U.S. Pat. Nos. 3,369,895 and 3,408,194 and German patent applications (OLS) Nos. 2,057,941, 2,213,461, 2,219,917, 2,261,361 and 2,263,875.

As magenta couplers, 5-pyrazolone type compounds are generally used. However, indazolone type compounds and cyanoacetyl compounds can also be used. Examples of such compounds include compounds as described in U.S. Pat. Nos. 2,439,098, 2,600,788, 3,062,653 and 3,558,319, British Pat. No. 956,261, U.S. Pat. Nos. 3,582,322, 3,615,506, 3,519,429, 3,311,476 and 3,419,391, Japanese patent applications Nos. 21454/73 and 56050/73, German Patent No. 1,810,464, Japanese patent publication No. 2016/69, Japanese patent application No. 45971/73 and U.S. Pat. No. 2,983,608.

As cyan couplers, phenol and naphthol derivatives are generally used. Examples of such couplers include compounds as described in U.S. Pat. Nos. 2,369,929, 2,474,293, 2,698,794, 2,895,826, 3,311,476, 3,458,315, 3,560,212, 3,582,322, 3,591,383, 3,386,301, 2,434,272, 2,706,684, 3,034,892 and 3,583,971, German patent application (OLS) No. 2,163,811, Japanese patent publication No. 28836/70 and Japanese patent application No. 33238/73.

Further, compounds which release a compound having a development inhibiting function by a color forming reaction (a DIR coupler) or compounds which release a compound having a development inhibiting function can be added. Examples of such compounds are described in U.S. Pat. No. 3,148,062, 3,227,554, 3,253,924, 3,617,291, 3,622,328 and 3,705,201, British Pat. No. 1,201,110 and U.S. Pat. Nos. 3,297,445, 3,379,529 and 3,639,417.

The amount of coupler present does not effect the process of the present invention in any substantial fashion (in a manner other than will be obvious to one skilled in the art), and typically any coupler will be utilized in an amount of from about 0.01 mol/m$^2$ to about 1.0 mol/m$^2$. Greater and lesser amounts can be used, of course.

In order to satisfy characteristics desired for the sensitive material, two or more couplers as described above may be added to one layer. Of course, one may add one coupler to two or more layers.

It is preferred that the couplers be insoluble in a mixture of a coupler solvent(s) (preferably, coupler solvents having a suitable polarity) and water. Examples of typical solvents include tri-o-cresyl phosphate, dibutyl phthalate, diethyllaurylamide, 2,4-diallylphenol and liquid dye stabilizing agents as described in *Product Licensing Index,* Vol. 83, pages 26 – 29 (1971, March), *Improved Photographic Dye Image Stabilizing Solvents.* Such procedures are conventional in the art.

It is preferred that the maximum absorption region of the cyan dye formed be in the range of about 600 to 680 nm, that of the magenta dye formed be in the range of about 500 to 580 nm and that of the yellow dye formed be in the range of about 400 to 480 nm.

The silver halide emulsions are produced in conventional manner by mixing a solution of a water soluble silver salt (for example, silver nitrate) and a solution of a water soluble halogen salt (for example, potassium bromide) in the presence of a solution of a water soluble high molecular weight material such as gelatin. As the silver halide, not only silver chloride and silver bromide but also mixed halides such as silver bromochloride, silver iodobromide and silver iodobromochloride can be used.

The silver halide grains may be in cubic form, octahedral form or a mixed crystal form thereof.

The particles of these silver halides are produced according to conventional process. Of course, they can be effectively produced by the single or double jet process or a controlled double jet process.

These photographic emulsions are described in *The Theory of the Photographic Process* which by C. E. K. Mees, published by Macmillan Co. and *Chimie Photographique written by P. Glafkides, published by Paul Montel Co.* (1957), and can be prepared by an ammonia process, a neutral process, an acid process, etc.

After formation of such silver halide particles, they are generally processed in a conventional manner, i.e., they are generally washed with water to remove by-produced water soluble salts (for example, potassium nitrate in the case of forming silver bromide by reacting silver nitrate with potassium bromide). They are then generally subjected to conventional heat treatment in a presence of a chemical sensitizing agent (such as sodium thiosulate, N,N,N'-trimethylthiourea, a monovalent gold thiocyanate complex salt, a thiosulfate complex salt, stannous chloride or hexamethylenetetramine, etc.) to increase sensitivity without increasing their particle size. These processes are described in the above described texts.

The above described silver halide emulsions may also be chemically sensitized in a conventional manner, if desired. Examples of chemical sensitizing agents used include gold compounds as described in U.S. Pat. Nos. 2,399,083, 2,540,085, 2,597,856 and 2,597,915 (for example, chloroaurate or gold trichloride, etc.), salts of noble metals (for example, platinum, palladium, iridium, rhodium or ruthenium, etc.) as described in U.S. Pat. Nos. 2,448,060, 2,540,086, 2,566,245 2,566,263 and 2,598,079, sulfur compounds which form silver sulfide by reacting with silver salts as described in U.S. Pat. Nos. 1,574,944, 2,410,689, 3,189,458 and 3,501,313, and reducing substances (for example, stannous salts or amines, etc.) as described in U.S. Pat. Nos. 2,487,850, 2,518,698, 2,521,925, 2,521,926, 2,694,637, 2,983,610 and 3,201,254.

Anti-fogging agents for silver halides may also be added to the photosensitive layer of the photographic sensitive material, if desired, in a manner as is well known in the art. Typical examples of preferred anti-fogging agents include heterocyclic organic compounds such as tetrazole, azaindene or triazoles, etc., and aromatic or heterocyclic compounds having a mercapto group, e.g., aromatic compounds such as mono-$\alpha$-mercapto-p-xylene and di-$\alpha,\alpha'$-mercapto-p-xylene and heterocyclic mercapto-p-xylene and di-$\alpha,\alpha'$-mercapto-p-xylene and heterocyclic compounds such as 2-mercapto-5-amino-thiazole and 2-mercapto-3-alkyl-benzothiazoline.

The photographic sensitive materials in the present invention may contain hardening agents, plasticizers, lubricating agents, surface active agents, glossing agents and other additives conventionally used in the photographic field, if desired.

As the hydrophilic colloids used as a binder, there can be illustrated gelatin, colloidal albumin, casein, cellulose derivatives such as carboxymethylcellulose or hydroxyethylcellulose, etc., sugar derivatives such as agar-agar, sodium alginate or starch derivatives, e.g., acetyl starch, etc., and synthetic hydrophilic colloids such as polyvinyl alcohol, poly-N-vinylpyrrolidone, acrylic acid copolymers, e.g., acrylic acid-vinyl ether copolymer, polyacrylamide or derivatives thereof, e.g., poly-N-methylacrylamide, and partially hydrolyzed products of them, etc. Two or more of these colloids can be used as a compatible mixture, if desired or necessary. Among these colloids, gelatin is usually used. However, a portion or all of the gelatin may be substituted for not only by synthetic high molecular weight materials but also by gelatin derivatives, e.g., those prepared by modifying amino group, imino groups, hydroxyl groups or carboxyl groups as functional groups in the gelatin molecule by treating with a chemical having a group which can react with these groups, e.g., anhydrous phthalic acid (one carboxy group thereof reacted) or graft polymers which are prepared by linking a molecular chain of another high molecular weight material to gelatin, e.g., polyacrylic amide. Such binders are conventional in the art, and the present invention is useful with such conventional binders.

The photographic emulsions may be subjected to spectral sensitization or supersensitization using one or more cyanine dyes such as cyanine dyes, merocyanine dyes or hemicyanine dyes or by using a combination of such dyes with styryl dyes, if desired or necessary. These color sensitization techniques are known and described in, for example, U.S. Pat. Nos. 2,493,748, 2,519,001, 2,977,229, 3,480,434, 3,672,897, 3,703,377, 2,688,545, 2,912,329, 3,397,060, 3,615,635 and 3,628,964, British Pat. Nos. 1,195,302, 1,242,588 and 1,293,862, German patent applications (OLS) Nos. 2,030,326 and 2,121,780, Japanese patent publications Nos. 4936/68, 14030/69 and 10773/68, U.S. Pat. Nos. 3,511,664, 3,522,052, 3,527,641, 3,615,613, 3,615,632, 3,617,295, 3,635,721 and 3,694,217 and British Pat. Nos. 1,137,580 and 1,216,203. Selection of the dyes can be suitably carried out according to the use or purpose of the sensitive material, such as the wavelength range to be sensitized or the sensitivity desired, etc.

The photographic emulsions are conventionally applied to planar materials which do not undergo any remarkable dimensional change during processing, for example, hard supports such as of glass, metal or porcelain or plastic supports. Examples of typical plastic supports include cellulose nitrate films, cellulose acetate films, cellulose acetate butyrate films, cellulose acetate propionate films, polyethylene terephthalate films and polycarbonate films and laminates of these films, thin glass films and paper, etc., as are usually used in the photographic sensitive materials. Good results can also be obtained by the use of paper which is coated or laminated by baryta or an $\alpha$-olefin polymer, particularly, a polymer of an $\alpha$-olefin having 2 to 10 carbon atoms such as polyethylene, polypropylene or an ethylene-butene copolymer, etc., or plastic films the surface of which was roughened so as to have good adhesion to other high molecular weight materials and to improve printability as is described in Japanese patent publication No. 19068/72.

The supports may be transparent or opaque, and are selected according to the use of the sensitive material. In the case of a transparent support, not only colorless transparent ones but also colored transparent ones which are prepared by adding dyes or pigments can be used. These supports have been hitherto used for X-ray films and are described in *J. SMPTE*, 67, 296 (1958).

As opaque supports, there are not only inherently opaque ones but also those prepared by adding pigments such as titanium dioxide to a transparent film, plastic films the surface of which has been previously treated by a method as described in Japanese patent publication No. 19068/72, and paper and plastic films which are prepared by adding carbon black or dyes which completely shield light thereto. In the case that adhesive strength between the support and a photographic emulsion layer is insufficient, a subbing layer which has good adhesion to both of them can be provided on the support. Further, in order to further improve adhesive strength, the surface of the support may be subjected to a treatment such as corona discharge, ultraviolet ray exposure, flame treatment, etc.

As described above, the color photographic sensitive materials used in the present invention are composed of a support and dye image-forming layer units on the support. Multilayer color photographic sensitive materials which give multicolor images have at least two dye image-forming layer units, each of which is sensitive to light in a different spectral region. Such a layer unit generally contains a photo-sensitive silver salt and is spectrally-sensitive to light in one spectral region and is generally combined with a photographic coupler. In order to prevent color stain between dye image-forming layer units, the layer units are effectively separated by barrier layers, spacer layers, layers containing an agent to remove oxidants of developing agents or other layers. Separation of the layer units is known in this technical field and is utilized in many commercial color sensitive materials. Moreover, photosensitive materials having a development stain preventing layer as described in U.S. Pat. No. 3,737,317 or Japanese patent applications Nos. 73445/73 and 113633/73 can be used in the present invention.

On the other hand, the compound of the present invention may effectively be added to a color developing solution or a color development intensifying solution in color intensifying image-forming processes using peroxides such as hyrogen peroxide or cobalt complex salts, as described in Japanese patent application No. 76101/74, German patent applications (OLS) Nos. 2,357,694, 2,357,695, 2,044,833, 2,056,359, 2,056,360 and 2,266,770, U.S. Pat. Nos. 3,674,490 and 3,761,265, Japanese patent applications (OPI) Nos. 9728/73, 9729/73, 84239/74 and 84240/74 and Japanese patent applications Nos. 128327/74 and 139917/74.

The present invention provides more excellent results than the prior art processes as follows.

First, the preservability of the developing solution of the present invention is remarkably excellent as compared with using hydroxylamines or hydroxyacetone.

Second, the compounds of the present invention have very low toxicity as compared with hydroxylamines.

Third, the anti-fogging effect or stain preventing effect is remarkably higher than in the case of using dihydroxyacetone.

Fourth, the compound in the present invention is more stable than $\beta$-anilinoethanol or dihydroxyalkenes. These effects remarkably appear in high temperature processing at above 30°, preferably at 30° to 45° C.

A typical example of processings suitable for the present invention is shown in the following. The present invention, however, is not limited to this example.

Color Negative Processings

| Processing step | Temperature (° C) | Time (minute) |
|---|---|---|
| Color development | 38 | 3 |
| Stopping | " | 1 |
| Water wash | " | 1 |
| Bleaching | " | 2 |
| Water wash | " | 1 |
| Fixing | " | 2 |
| Water wash | " | 1 |
| Stabilizing bath | " | 1 |

The color developing solution used had the following composition.

| | | |
|---|---|---|
| Sodium hydroxide | 2 | g |
| Sodium sulfite | 2 | g |
| Potassium bromide | 0.4 | g |
| Sodium chloride | 1 | g |
| Borax | 4 | g |
| Hydroxyurea | 2 | g |
| Disodium ethylenediaminetetraacetate dihydrate | 2 | g |
| 4-Amino-3-methyl-N-ethyl-N-($\beta$-hydroxyethyl)aniline monosulfate | 4 | g |
| Water to make | 1 | l |

Color Reversal Processing

| Processing step | Temperature (° C) | Time (second) |
|---|---|---|
| First development | 40 | 5 |
| Color development | " | 15 |
| Stopping | " | 10 |

-continued

| | | |
|---|---|---|
| Bleach stabilizing bath | " | 90 |

The color developing solution used has the following composition.

| | | |
|---|---|---|
| Sodium sulfite | 5 | g |
| Hydroxyurea | 2 | g |
| 4-Amino-3-methyl-N-ethyl-N-(β-hydroxyethyl)aniline sulfate | 10 | g |
| Trisodium phosphate (12 hydrate) | 100 | g |
| Tri-(hydroxymethyl)nitromethane | 3 | g |
| Ethylenediamine (70% aqueous solution) | 11 | ml |
| Sodium hydroxide | 0.1 | g |
| Water to make | 1 | l |

Intensification Processing

| Processing step | Temperature (° C) | Time (minute) |
|---|---|---|
| Color development | 40 | 1 |
| Intensification | " | 2 |
| Bleach-fixing | " | 1 |
| Water wash | 26 | 2 |

The color developer used had the following composition.

| | | |
|---|---|---|
| Benzyl alcohol | 15 | ml |
| Potassium sulfite | 3.5 | g |
| Potassium bromide | 0.5 | g |
| Hydroxyurea | 2.0 | g |
| 4-Amino-3-methyl-N-ethyl-N-(β-hydroxyethyl)aniline monosulfate | 7.5 | g |
| Sodium carbonate | 30 | g |
| Nitrilotriacetic acid | 5 | g |

The intensification described above means a process as described in Japanese patent applications (OPI) Nos. 9728/73 and 9729/73.

While not to be construed as limitative, development in accordance with the present invention is usually effected in about 5 seconds to about 60 minutes at a temperature of from about 20° to about 60° C, preferably in 10 seconds to 60 minutes at 20° to 50° C, more preferably at 20 seconds to 30 minutes at 25° to 45° C, and most preferably in 30 seconds to 10 minutes at 30° to 45° C.

Having thus generally described the invention, the following Examples are offered to present currently preferred modes of practicing the invention. Unless otherwise indicated, in the Examples all processings were at room temperature and at atmospheric pressure and all percentages were weight percentages.

EXAMPLE 1

To a polyethylene coated paper support, a blue-sensitive silver bromide emulsion layer containing an emulsified dispersion of a yellow coupler, a green-sensitive silver chlorobromide (silver chloride: 70% by mol) emulsion layer containing an emulsified dispersion of a magenta coupler, a red-sensitive silver chlorobromide (silver chloride: 70% by mol) emulsion layer containing an emulsified dispersion of a cyan coupler and a gelatin layer containing an untraviolet ray absorbing agent were applied in the recited order to yield a color paper sheet. Each coupler emulsion used in the color paper sheet was prepared by dissolving each coupler in a mixture of dibutyl phthalate and tricresyl phosphate and dispersing the resultant solution in a gelative solution using sorbitan monolaurate, Turkey red oil and sodium dodecylbenzene sulfonate as emulsifying agents to produce an o/w type emulsion.

As the couplers, α-(2-methylbenzoyl)-aceto-(2'-chloro-5'-dodecoxycarbonyl)anilide as the yellow coupler, 1-(2',4',6'-trichlorophenyl-3-[3'-(2'',4''-di-t-amylphenoxyacetamide)-benzamide]-5-pyrazolone as the magenta coupler and 1-hydroxy-4-chloro-2-n-dodecylnaphthamide as the cyan coupler were used. As the ultraviolet ray absorbing agent, Compound 5 described in Japanese patent publication No. 9586/70 page 5 was used. 5-Methyl-7-hydroxy-1,3,4-triazaindolizine was added as an anti-fogging agent to the emulsion in an amount of $5 \times 10^{-3}$ mol/mol of silver halide.

The amounts of the couplers and the silver salts in the color paper were as follows.

| Layer | Amount of Coupler (g/m²) | Amount of Silver Salt (Ag g/m²) |
|---|---|---|
| Red-sensitive layer | 0.4 | 0.5 |
| Green-sensitive layer | 0.5 | 0.6 |
| Blue-sensitive layer | 0.4 | 0.8 |

This photographic element was exposed to light (1 second; 500 C.M.S.) by means of a sensitometer and processed as follows.

| Processing step | Temperature (° C) | Time |
|---|---|---|
| Color development | 31 | 3 minutes and 30 seconds |
| Bleach-fixing | " | 1 minute and 30 seconds |
| Water wash | " | 2 minutes |
| Stabilization | " | 1 minute |

Color developing solution

| | | |
|---|---|---|
| Benzyl alcohol | 14 | ml |
| Sodium sulfite | 2 | g |
| Potassium bromide | 0.5 | g |
| Sodium carbonate (monohydrate) | 30 | g |
| 4-Amino-N-ethyl-N-(β-methanesulfonamido)-m-toluidine sesquisulfate monohydrate | 5 | g |
| Additives (refer to Table 1) | | |
| Water to make | 1 | l |

Bleach-fixing solution

| | | |
|---|---|---|
| Ammonium thiosulfate (70% aqueous solution) | 150 | ml |
| Sodium sulfite | 5 | g |
| Na[Fe(EDTA)] | 40 | g |
| EDTA | 4 | g |
| Water to make | 1 | l |

(EDTA: Ethylenediaminetetraacetic acid)

Stabilizing solution

| | | |
|---|---|---|
| Glacial acetic acid | 10 | ml |
| Sodium acetate | 5 | g |
| Formaldehyde (37% aqueous solution) | 5 | ml |
| Water to make | 1 | l |

The results obtained are shown in Table 1.

TABLE 1

| Experiment No. | Additive in Color Developing Solution | Magenta Fog Density after Standing at 31° C for 7 Days | Amount of Color Developing Agent after Standing at 31° C for 7 Days (g/l) |
|---|---|---|---|
| 1 | No addition (comparison) | 0.14 | 1.54 |
| 2 | Hydroxylamine sulfate | 0.12 | 3.45 |
| 3 | Dihydroxyacetone | 0.14 | 2.87 |
| 4 | Compound 1 in the present invention | 0.10 | 3.10 |
| 5 | Compound 2 in the present invention | 0.10 | 2.97 |
| 6 | Compound 3 in the present invention | 0.10 | 2.85 |
| 7 | Compound 4 in the present invention | 0.09 | 2.70 |
| 8 | Compound 5 in the present invention | 0.09 | 3.93 |
| 9 | Compound 6 in the present invention | 0.10 | 3.15 |

It can be understood from the above results that the compounds of the present invention (Experiments 4 to 9; Experiments 1 to 3 are Comparisons) give a preservability similar to or more excellent than hydroxylamine or dihydroxyacetone.

While the invention has been described in detail and with reference to specific embodiments thereof, it will be apparent to one skilled in the art that various changes and modifications can be made therein without departing from the spirit and scope thereof.

What is claimed is:

1. A process for stabilizing a color developing solution containing one or more p-phenylenediamine derivatives which comprises adding one or more hydroxamic acid compounds represented by the following formula to the color developing solution:

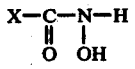

wherein X represents a hydrogen atom, an alkyl group having 1 to 4 carbon atoms, an unsubstituted or substituted aryl group having 6 to 10 carbon atoms, an amino group, an alkylamino group having 1 to 4 carbon atoms or an arylamino group.

2. The process of claim 1, wherein said one or more hydroxamic acids are added in an amount of from about 0.001 to about 20 g per liter of the developing solution.

3. The process of claim 1, wherein said one or more hydroxamic acids are added in an amount of from 0.01 to 10 g per liter of the developing solution.

4. The process of claim 3, wherein said developing solution is at a pH of from about 7 to 14.

5. In a process for developing an imagewise exposed color photographic material by bringing said material into contact with a color developing solution containing one or more p-phenylenediamine derivatives as a color developing agent, the improvement wherein said color developing solution comprises one or more hydroxamic acid compounds represented by the following formula:

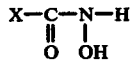

wherein X represents a hydrogen atom, an alkyl group having 1 to 4 carbon atoms, an unsubstituted or substitured aryl group having 6 to 10 carbon atoms, an amino group, an alkylamino group having 1 to 4 carbon atoms or an arylamino group.

6. The process of claim 5, wherein said one or more hydroxamic acids are present in said solution in an amount of from about 0.001 to about 20 grams per liter.

7. The process of claim 5, wherein said one or more hydorxamic acids are present in said solution in an amount of from 0.01 to 10 grams per liter.

8. The process of claim 7 wherein said developing solution is at a pH of from about 7 to 14.

9. The process of claim 1, wherein X is selected from the group consisting of phenyl, alkylphenyl, alkoxyphenyl, hydroxyphenyl, anilino, toluidino, anisidino or xylydino.

10. The process of claim 5, wherein X is selected from the group consisting of phenyl, alkylphenyl, alkoxyphenyl, hydroxyphenyl, anilino, toluidino, anisidino or xylydino.

11. The process of claim 1, wherein X is a substituted phenyl group and the substituent is selected from the group consisting of alkyl, alkoxy, acyl, carboxyl, sulfo, halogen, hydroxyl, amino or nitro.

12. The process of claim 5, wherein X is a substituted phenyl group and is the substituent selected from the group consisting of alkyl, alkoxy, acyl, carboxyl, sulfo, halogen, hydroxyl, amino or nitro.

13. The process of claim 1, wherein X is a substituted phenyl group and the substituent is selected from the group consisting of cyano, formyl, hydroxyalkyl, aminoalkyl, carboxyalkyl, sulfoalkyl, halogenated alkyl or nitroalkyl.

14. The process of claim 5, wherein X is substituted phenyl group and the substituent is selected from the group consisting of cyano, formyl, hydroxyalkyl, aminoalkyl, carboxyalkyl, sulfoalkyl, halogenated alkyl or nitroalkyl.

15. The process of claim 1, wherein X is a substituted phenyl group and the substituent is selected from the group consisting of cyanoalkyl or formylalkyl.

16. The process of claim 5, wherein X is a substituted phenyl group and the substituent is selected from the group consisting of cyanoalkyl or formylalkyl.

17. The process of claim 1, wherein X is selected from the group consisting of —H, $-CH_3$, $-C_6H_5$, ortho $-C_6H_4OH$, $-NH_2$, $-NHCH_3$ or $-NHC_6H_5$.

18. The process of claim 5, wherein X is selected from the group consisting of —H, $-CH_3$, $-C_6H_5$, ortho $-C_6H_4OH$, $-NH_2$, $-NHCH_3$ or $-NHC_6H_5$.

* * * * *